US008188663B2

(12) United States Patent
Böröczki et al.

(10) Patent No.: US 8,188,663 B2
(45) Date of Patent: May 29, 2012

(54) HIGH INTENSITY DISCHARGE LAMP

(75) Inventors: Ágoston Böröczki, Rózsa (HU); Csaba Horváth, Juhász Gyula (HU)

(73) Assignee: General Electric Company, Schenectady, NY (US)

( * ) Notice: Subject to any disclaimer, the term of this patent is extended or adjusted under 35 U.S.C. 154(b) by 494 days.

(21) Appl. No.: 12/348,662

(22) Filed: Jan. 5, 2009

(65) Prior Publication Data

US 2010/0171422 A1 Jul. 8, 2010

(51) Int. Cl.
*H01J 17/04* (2012.01)

(52) U.S. Cl. ..... 313/631

(58) Field of Classification Search ..... 313/258, 313/357, 613, 626, 628, 631, 632, 634
See application file for complete search history.

(56) References Cited

U.S. PATENT DOCUMENTS 2,177,714 A * 10/1939 Hagen et al. ..... 313/623
2,879,427 A * 3/1959 Delrieu ..... 313/575
4,105,908 A 8/1978 Harding et al.
4,232,243 A 11/1980 Rigden
4,396,856 A * 8/1983 Ogata et al. ..... 313/632
4,893,057 A 1/1990 Tillman nee Caruso et al.

* cited by examiner

*Primary Examiner* — Toan Ton
*Assistant Examiner* — Andrew Coughlin
(74) *Attorney, Agent, or Firm* — Fay Sharpe LLP

(57) ABSTRACT

A high intensity discharge lamp comprising a discharge vessel having a wall enclosing a discharge space, an ionizable material contained in said space, and at least two electrodes each having an embedded portion and an electrode shaft extending from the wall of the discharge vessel and ending with a tip of the electrode, the electrodes being arranged in said space for establishment of an electric arc between said tips. Each of the electrode shafts of the electrodes comprises a thickened portion arranged between the embedded portion and the tip of the electrode, a first shaft section extending between the embedded portion and the thickened portion, the first shaft section having a first length and a first shaft diameter, and a second shaft section extending between the thickened portion and the tip of the electrode, the second shaft section having a second length and a second shaft diameter. The thickened portion has a greater overall diameter than any of the first and second shaft diameters thereby having a higher specific surface than the specific surface of the first shaft section and the specific surface of the second shaft section, respectively, and being arranged to limit the temperature of the electrode shaft at the inner wall by heat dissipation. The thickened portion has a minimum distance from the inner wall of at least 50% of the first shaft diameter, the length of the second shaft section is at least 100% of the second shaft diameter, and the first length is at most equal to the second length.

16 Claims, 4 Drawing Sheets

HIGH INTENSITY DISCHARGE LAMP

FIELD OF THE INVENTION

This invention relates to a high intensity discharge (HID) lamp, more particularly to discharge lamps with electrodes suitable for temperature limitation.

BACKGROUND OF THE INVENTION

The electrode construction of high intensity discharge lamps is governed by multiple requirements that have to be fulfilled simultaneously for proper electrode operation. The lamps have to start reliably, and function properly under steady-state conditions. Starting and steady state operating regimes of the electrodes set different and often contradicting constraints for a suitable electrode structure.

During the starting (i.e. ignition) and the run-up transition phases of lamp operation, the electrodes run through the glow and the glow-to-arc transition modes with currents differing in orders of magnitudes. For a long useful product life, these transition phases have to be as short as possible in order to reduce electrode degradation due to sputtering by heavy particle bombardment from the discharge plasma and due to excess evaporation rate of electrode material close to or sometimes even above its melting-point temperature. In the course of these transition phases of electrode operation, discharge plasma is generated in the lamp and adequate energy transfer from the plasma to the electrodes is required in general. The transferred energy heats the electrodes up to temperatures where thermionic electrode emission assisted by electric field provides the required take-over current of the lamp to keep it in operation, and then brings it into steady-state conditions.

Once the electrodes have been heated up to their steady-state operating temperature, spatial temperature distribution of the electrodes have to be properly adjusted to provide the required discharge current at their interface area with the discharge plasma. On the other hand, appropriate temperature gradients not only across the electrode front face but also along the electrode axis have to be established to avoid excess evaporation of electrode material, flickering, arc anchor point movements, and overheating the electrode foot-points.

The set of requirements concerning the electrodes of high intensity discharge lamps with high take-over, run-up and/or steady-state operating currents, and especially of high intensity discharge lamps for automotive applications is even more demanding. In the case of high intensity discharge lamps for automotive applications, there are additional constrains set for the electrode shaft diameter, the electrode tip geometry and positioning, which are related to the performance of the lamp in optical projection systems (automotive headlamps). In addition, the requirements of 'instant light' generation and 'hot re-start' ability imply heavy lamp currents and heavy electrode overload during the starting and run-up transition phases of lamp operation. Automotive headlamps are generally heated with a power of 70 W to 90 W during lamp run-up, which power is gradually decreased to 35 W within approximately 30 s to reach rated steady-state lamp power value and lamp operation conditions. Consequently during this run-up phase, a substantial part of the electrode bodies is running at much higher temperatures compared to the steady-state conditions. This results in extremely high electrode foot-point temperatures, while the surrounding discharge vessel wall temperature is low: close to the temperature values of a non-operational lamp. The high spatial and temporal temperature gradients in the vessel wall at the hot electrode foot-points and beyond this point, that is in the sealing sections responsible for vacuum-tight closing of the discharge vessel (pinch seal sections), lead to extremely high thermally induced mechanical stress levels in the glass of the seal surrounding the electrodes. These thermally induced high mechanical stresses generate cracks and crack propagation in these pinch or shrink seal sections when the lamps are repetitively started and then switched off. This results in formation of leaking channels and in turn the loss of filling gas and dosing constituents of the discharge chamber, thus finally making the lamp inoperative. Such short-lived lamps severely affect product life performance and reliability, thereby road safety is also affected in a negative way, and vehicle maintenance costs are increased.

It is known from the prior art that the electrodes of high intensity discharge lamps often have a coil structure close to the electrode tip. The role of such coil component is partly to help ignition and partly to set the proper axial temperature gradients along the axis of the electrode, and especially in the area close to the electrode tip, via enhanced radiative cooling.

A metal halide lamp with such coil arrangement is disclosed e.g. in U.S. Pat. No. 4,105,908. The glow-to-arc transition of this known lamp is speeded up by using electrodes comprising an open tungsten wire coil on a tungsten shaft, the coil comprising two layers of a composite wire made by open-winding an overwind on a core and then close-winding two layers of the composite wire on the shaft. Although this structure decreases sputtering at starting and reduces glow-to-arc transition time, the disclosed coil structure is placed relatively close to the electrode tip, which is in contradiction with applicable standards set for high intensity discharge lamps by the automotive industry. Thereby, this known lamp cannot be used in this technical field.

A high-pressure electric discharge lamp is disclosed in U.S. Pat. No. 4,232,243. The electrodes thereof preferably comprise tungsten wire coils arranged relatively close to the electrode tip, which arrangement has the same disadvantages as above.

A HID lamp is disclosed further in U.S. Pat. No. 4,893,057. This known HID lamp incorporates 'all-metal' electrodes providing rapid transition of the arc to the electrode tip. The electrode comprises a length of thoriated tungsten wire having a close wrapped coil at tip ends, so that rapid heating of the electrode tip promotes rapid transition of the arc from coil crevices to the tip. Again, the coil is relatively close to the electrode tip and contributes exclusively to the ignition, instead of also limiting temperature at electrode foot-points.

The electrodes currently used in high intensity discharge lamps for automotive applications have a more simple geometry. These electrodes do not have a coil component on the electrode shaft at least definitely not inside the arc chamber. This is because these lamps have to be in conformance with some additional constraints, which is basically related to the optical design of the headlamps/projecting reflectors where these lamps are used. The strict constraints related to such optical considerations and the extremely compact geometry of the discharge vessel of these amps generally do not allow additional components to be arranged at and close to the tips on the electrode shaft. The axial temperature distribution of the electrodes is governed by a power balance between the input power at the electrode tip interfacing with the discharge plasma, the radiative and conductive/convective cooling on the cylindrical side surface of the electrode shaft, and the conductive power loss across the shaft cross section towards the electrode foot-point area.

It is also generally known in the art that a coil may be used on electrodes of high intensity discharge lamps of high operating currents to lower the thermal load on the glass wall at the electrode foot-point. In contrast with the coil located close to the tip of the electrode shaft described previously, such a coil is located outside the discharge chamber and surrounded by the wall material of the discharge chamber, i.e. it is 'pinched' into the bulk glass material of the glass-to-metal seal at the discharge chamber end section. Despite the advantage of this coil structure in increasing the electrode foot-point surface and thus lowering the power load per unit surface on the glass surrounding the coiled electrode section, it is not frequently used in high intensity discharge lamp products. One reason for this is a dose loss in the micro channels surrounding the coil component in the glass wall. During lamp operation, the dose constituents slowly migrate outwards from the discharge chamber and fill the micro channels around the coil on the electrode in the seal. The result of this dose migration is a gradual change in lamp parameters. This is because the amount of the dose in the arc chamber and its temperature (the 'cold spot temperature') are important factors which determine the electrical and optical parameters of the lamp, especially the color performance and the luminous flux of metal halide lamps. Such a gradual—and often very rapid—change in lamp performance caused by the significant dose loss in the micro channels is unacceptable.

The other result of dose loss in micro channels surrounding the coil on the electrode in the seal is the build-up of a dose reservoir in the micro channels. Since the thermal expansion coefficient of e.g. the metal halide dose component can be greater by orders of magnitude than that of the quartz glass surrounding the channels, cracks may be generated by the mechanical stresses from this thermal expansion mismatch between the quartz glass and the metal halide dose components in the reservoir. Finally, the lamp may become leaking and inoperative, or can even be ruptured.

Thus, there is a particular need to provide a high intensity discharge lamp with electrodes limiting the temperature of the electrode foot-points by enhanced heat dissipation (mainly by radiation and additionally by convection/conduction through the surrounding discharge gas and vapour in the discharge vessel) along the electrode shaft within the discharge vessel. There is also a need for a simpler foot-point temperature limiting structure than that with the embedded coil. There is a further need to provide such a lamp with an electrode structure that has no additional elements close to its tip portion pointing towards the central region of the discharge vessel.

SUMMARY OF THE INVENTION

In an exemplary embodiment of the invention, a high intensity discharge lamp is provided, which comprises a discharge vessel having a wall enclosing a discharge space, an ionizable material contained in said space, and at least two electrodes each having an embedded portion and an electrode shaft extending from the wall of the discharge vessel and ending with a tip of the electrode, the electrodes being arranged in said space for establishment of an electric arc between said tips, wherein each of the electrode shafts of the electrodes comprises a thickened portion arranged between the embedded portion and the tip of the electrode, a first shaft section extending between the embedded portion and the thickened portion, the first shaft section having a first length and a first shaft diameter, and a second shaft section extending between the thickened portion and the tip of the electrode, the second shaft section having a second length and a second shaft diameter, and wherein the thickened portion has a greater overall diameter than any of the first and second shaft diameters thereby having a specific surface higher than the specific surface of the first shaft section and the specific surface of the second shaft section, respectively, and being arranged to limit the temperature of the electrode shaft at the inner wall by heat dissipation, and the thickened portion has a minimum distance from the inner wall of at least 50% of the first shaft diameter, the length of the second shaft section is at least 100% of the second shaft diameter, and the first length is at most equal to the second length.

The proposed electrode structure can preferably be used in high intensity discharge lamps with high take-over, run-up and/or steady-state operating currents. The proposed electrode geometry is especially applicable to high intensity discharge lamps for automotive applications. The invention has the advantage over the prior art that the thickened portion arranged close to the inner wall ensures effective cooling of the foot-point of the electrode, while the remaining part of the electrode shaft is unaffected, thereby allowing its use in applications where additional elements around the electrode tips are undesirable.

BRIEF DESCRIPTION OF THE DRAWINGS

The invention will now be described in detail with reference to the enclosed drawings, in which.

DETAILED DESCRIPTION OF THE INVENTION

Figure 1:
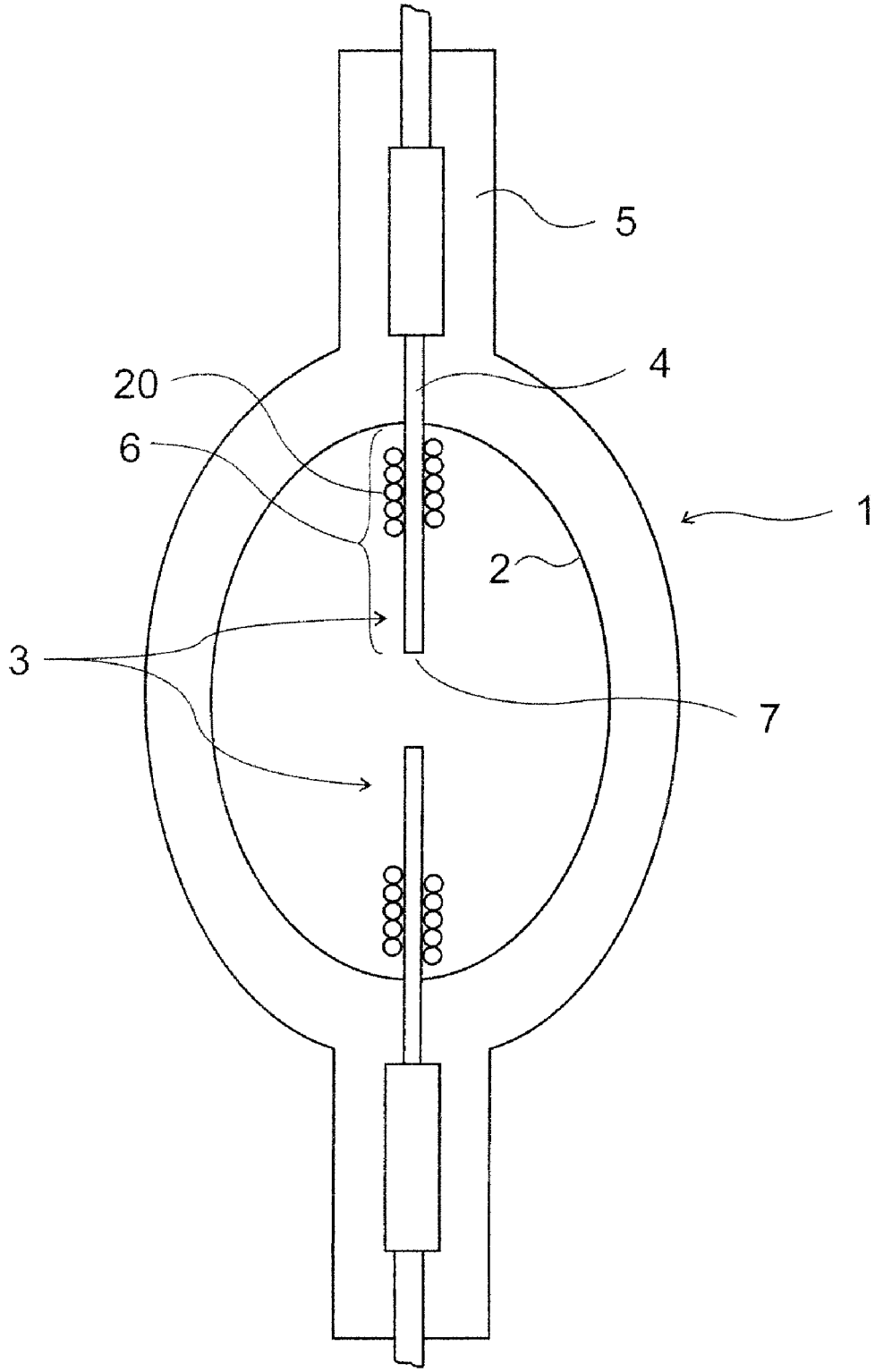
FIG. 1 is a longitudinal cross sectional view of a preferred embodiment of a high intensity discharge lamp.
Figure 2:
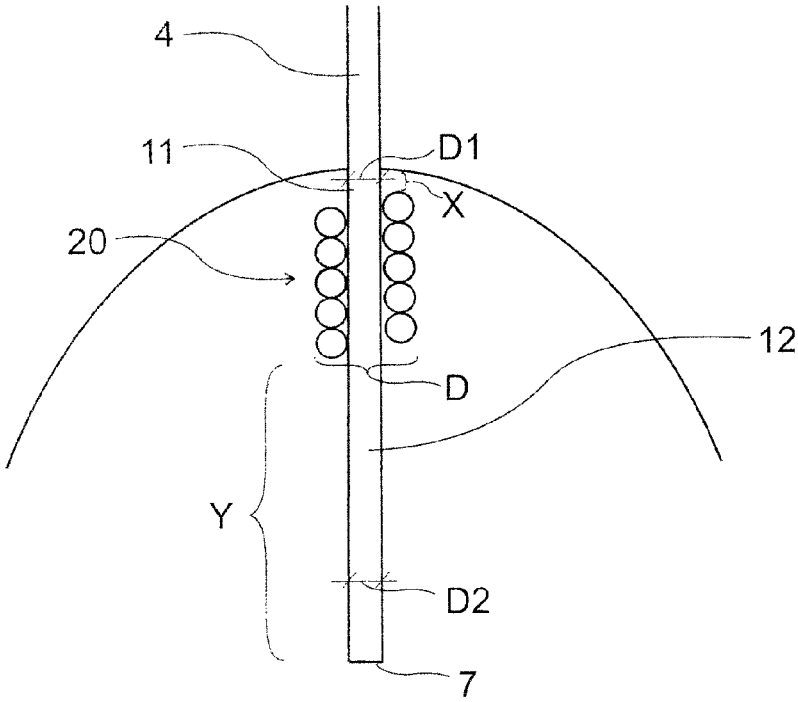
FIG. 2 is an enlarged schematic cross sectional view of the electrode structure shown in FIG. 1, and FIGS. 3 to 10 are schematic cross sectional views of further preferred embodiments of the electrode structure.

Referring first to FIGS. 1 and 2, a high intensity discharge lamp 1 is shown with an exemplary embodiment of the electrode structure. The high intensity discharge lamp 1 comprises a discharge vessel having a wall 2 enclosing a discharge space and an ionizable material contained in said space.

At least two electrodes 3 are arranged in the lamp, each having an embedded portion 4 preferably sealed into the wall 2 by means of a pinch seal or shrink seal section 5 of the discharge vessel. The electrodes 3 also have an electrode shaft 6 extending from the inner wall 2 to a tip 7. The electrodes are arranged in the discharge space for establishing an electric arc between the tips 7.

Each of the electrode shafts 6 of the electrodes 3 comprises a thickened portion 20 between the embedded portion 4 and the tip 7 of the electrode 3, a first shaft section 11 extending between the embedded portion 4 and the thickened portion 20, and having a first length X and a first shaft diameter D1, as well as a second shaft section 12 extending between the thickened portion 20 and the tip 7 of the electrode 3, and having a second length Y and a second shaft diameter D2. The thickened portion is preferably formed as a coil arranged on the electrode shaft 6.

The thickened portion 20 has a greater overall diameter D than any of the first and second shaft diameters D1 and D2 with the assumption that D1 and D2 do not necessarily differ from each other. Since the thickened portion 20 has a greater diameter, it also has a higher specific surface than that of the first and second shaft sections 11 and 12. Overall diameter in this context means an all-encompassing diameter, i.e. a diameter of a smallest virtual cylinder being parallel with the electrode shaft and enclosing the thickened portion 20. Specific surface in this context means the ratio of section surface/section length for a given electrode section. Due to its higher specific surface, the thickened portion 20 limits the temperature of the electrode shaft 6 at the inner wall 2, i.e. at the electrode foot-point by heat dissipation, mainly by radiation and additionally by convection/conduction through the surrounding gas and vapour in the discharge vessel.

In order to achieve the desired effects of the proposed electrode structure, the thickened portion 20 must not touch the inner wall 2 of the discharge vessel, but must preferably be arranged close to the inner wall 2. In this way, a localized temperature-limitation of the electrode foot-point is achieved by means of enhanced heat dissipation of the electrode shaft 6, i.e. by means of an enhanced heat exchange between the vessel wall 2 at the discharge vessel end portions and the hotter electrode shaft 6, but without any negative, concentrated overheating effect for the wall 2 around the thickened portion 20. Our experiments showed that the thickened portion 20 should be spaced apart from the inner wall 2 with a minimum distance of at least 50% of the first shaft diameter D1. Minimum distance in this context means the distance from the inner wall 2 of the thickened portion's closest point to the inner wall 2. Such a minimum distance will eliminate manufacturability and positioning accuracy concerns related to unwanted contacting of the wall 2 and the thickened portion 20, while still ensuring the localized temperature-limiting function of the electrode foot-points. Further, the thickened portion 20 should be spaced apart from the tip 7 of the electrode for ensuring a static arc, i.e. for avoiding a flickering effect caused by arc 'jumping' between the tip 7 and the thickened portion 20. Our experiments showed that a flickering effect is avoided if the length Y of the second shaft section is at least 100% of the second shaft diameter D2. For localized temperature-limitation of the electrode foot-points and for arc stability at the electrode tip 7, as well as for leaving the central region of the discharge vessel free from additional electrode components, the first length X should be at most equal to the second length Y.

Thus, the proposed electrode structure has a thickened portion 20 on the electrode shaft. The thickened portion 20 is preferably formed as a coil element disposed on the electrode shaft. In contrast to prior art electrode structures, however this thickened portion 20 is located entirely inside the arc chamber, and does not have any direct contact with the discharge vessel wall at all. The thickened portion 20 must be placed as close to the electrode foot-point as possible. In this way the disadvantages of the electrode construction having a coil covered by the wall material of the discharge vessel, as described in the discussion of the general prior art, can be eliminated. Thereby the generation and propagation of micro cracks in the glass-to-metal seal around the coil can be avoided.

At the same time, the temperature of the foot-point of the electrode shaft 6 is limited, i.e. the electrode shaft 6 is efficiently cooled by the mainly radiative power loss on the surface of the thickened portion. This mainly radiative cooling effect is most efficient during the starting and run-up phases of the lamp when the temperature of the electrode shaft 6 is much higher also in the area of the thickened portion because of the current overload of the electrodes. In this way with the proposed electrode structure, the thermal load on the discharge chamber wall at the electrode foot-point is decreased since the conducted power through the electrode shaft 6 towards the foot-point is reduced by the amount of the mainly radiative power loss on the thickened portion 20.

On the other hand, since the thickened portion 20 of the proposed electrode structure is spaced apart from the tip 7 of the electrode, the temperature of the front surface of the electrode shaft 6 is basically unaffected by the thickened portion 20 under steady-state operating conditions of the lamp. This is in contrast with the prior art structures, where a coil is located close to the tip area of the electrode shaft. In addition to the unchanged electrode tip temperature distribution, the optical restrictions related to the tip part of the electrodes can also be easily satisfied by the proposed structure, since the geometry of the electrode shaft close to the tip is not affected by the thickened portion 20.

The dimensions of the thickened portion 20 have to be adjusted to the simultaneous requirements set for the temperature at the electrode foot-point and at the electrode tip, the geometrical restrictions for the electrode tip area, as well as the manufacturability and positioning accuracy restrictions. The thickened portion 20 has to ensure the high required (mainly) radiative power loss during the starting and run-up phases, as well as the much more reduced optimum dissipative power loss during steady state conditions.

In a preferred embodiment, the second length is at least 150%, preferably at least 200% of the second shaft diameter D2. This spacing from the tip 7 enables a more concentrated cooling for the electrode foot-point, while the electrode parameters in the surrounding of the tip 7 are even less influenced.

In the depicted embodiments, the first shaft diameter D1 and the second shaft diameter D2 are equal by applying an electrode shaft 6 having a uniform diameter along its length. However, D1 and D2 can be different as well, while the thickened portion 20 always has a greater overall diameter D than any of the first and second shaft diameters D1, D2.

Figure 3:
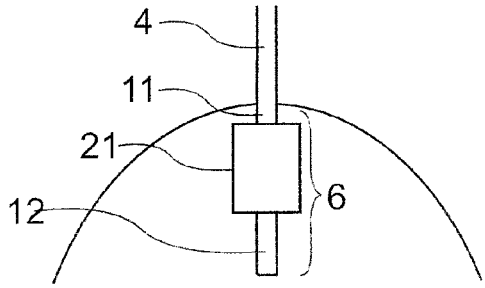
Figure 4:
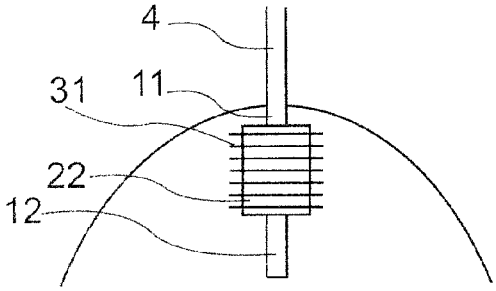
Figure 5:
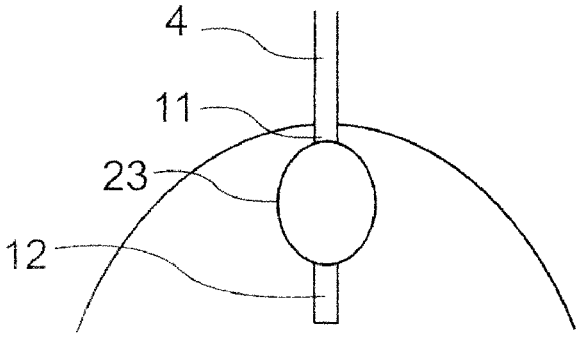
Figure 6:
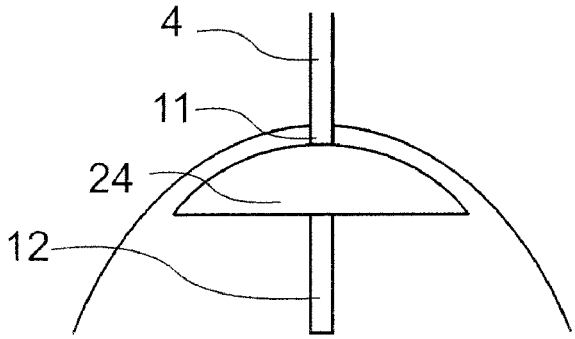

The thickened portion can also be formed as an axially quasi-symmetric body on the electrode shaft 6. FIGS. 3 to 10 depict exemplary embodiments of axially quasi-symmetric bodies on the electrode shaft 6. The body can be manufactured separately and fixed e.g. by welding on the electrode shaft 6, or can be manufactured integrally with the electrode shaft 6. The body can have a ribbed or uneven surface in order to further increase the specific surface resulting in a more effective cooling of the electrode foot-point. A thickened portion 21 may be a cylindrical shaped body as shown in FIG. 3. A cylindrical shaped thickened portion 22 furnished with circular ribs 31 is depicted in FIG. 4. The body can also have a ball, ellipsoidal, or conical shape. A thickened portion 23 with an ellipsoidal shaped body is shown in FIG. 5.

Figure 7:
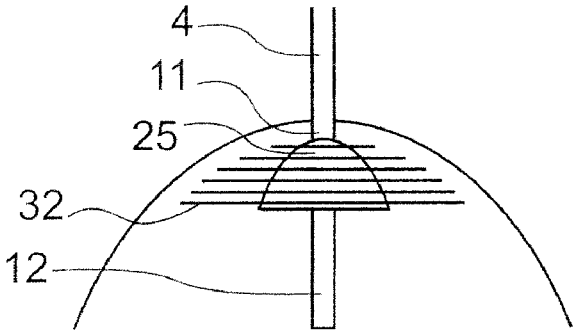
Figure 8:
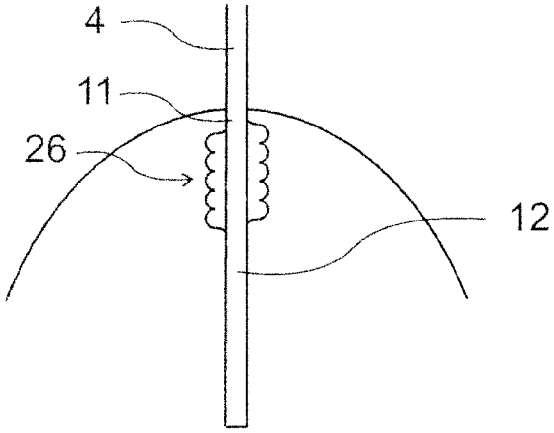

In a particularly preferred embodiment, the body of the thickened portion has a shape tapering towards the wall 2, the tapering shape preferably following the shape of the inner wall 2 of the discharge vessel. Such thickened portions 24 and 25 are shown in exaggerated form in FIGS. 6 and 7, respectively. The dimensions of the thickened portions 24 and 25 have to be selected in a way to avoid any manufacturability problem of the arc tube itself, e.g. the thickened portions 24 and 25 must fit and slip into the hole of the end section of the discharge vessel before sealing of the end section of the vessel is performed. The thickened portion 24 in FIG. 6 has a shape of an ellipsoid-section having an outer wall running essentially parallel with the inner wall 2 of the discharge vessel. The thickened portion 25 in FIG. 7 is furnished with circular ribs 32, the edges of which are essentially following the shape of the inner wall 2 of the discharge vessel, i.e. the distances between the wall 2 and the edges of the ribs 32 are more or less the same for all ribs 32. These embodiments have two main advantages. Firstly, the thickened portions 24, 25 heat the wall 2 in an essentially uniform way, thereby avoid local overheating of the discharge vessel. Secondly, the thickened portions 24, 25 can be arranged as close to the wall 2 as possible while providing the highest possible specific surface, thereby ensuring a high heat dissipation efficiency and leaving the central section of the discharge vessel free from any additional electrode elements. This is very important e.g. in automotive applications, where applicable standards may prohibit the addition of special electrode elements in a central region of the lamp.

Figure 9:
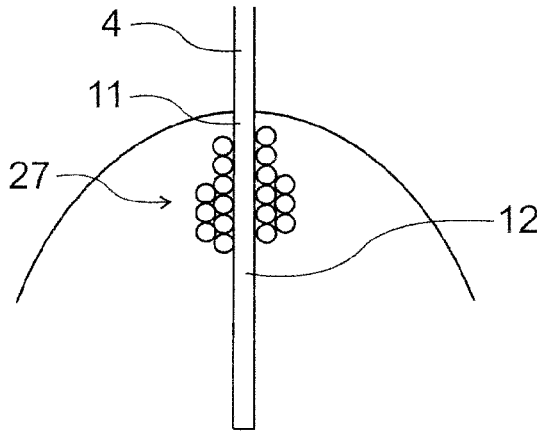

In a further preferred embodiment, the thickened portion is formed as a coil on the electrode shaft 6, the coil being preferably welded, more preferably melted onto the electrode shaft. Such a melted thickened portion 26 can be seen in FIG. 8. By means of the welded or melted structure, the heat transfer is enhanced between the contacting surface of the electrode shaft 6 and the thickened portion 26 and a more rigid construction is accomplished. As depicted in FIG. 9, the coil forming a thickened portion 27 can be a multi-layer coil, preferably having more layers of windings on its side facing towards the tip than on its side facing towards the embedded portion 4. Thickened portions can be formed very easily as coils around the surface of the electrode shaft 6 in essentially the same manner as the prior art coils are formed at the electrode tips 7. A tapering coil structure has similar advantages, as the embodiments of FIGS. 6 and 7.

Figure 10:
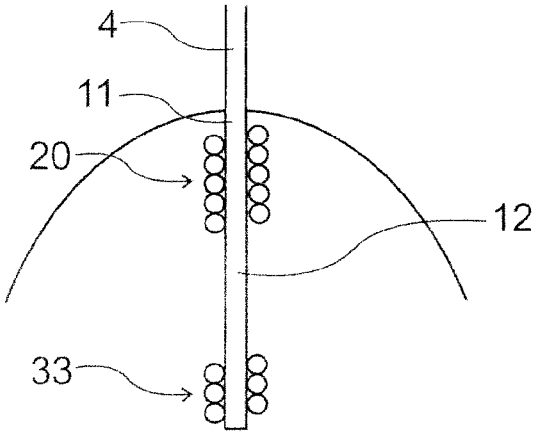

The embodiments of the electrode structure described above allow the application of prior art electrode manufacturing techniques to the electrode tips. As depicted in FIG. 10, in addition to the thickened portion 20, the second shaft section 12 can be provided with a further thickening 33 at the tip. The further thickening 33 is preferably formed as a coil known from the prior art, which can be welded, more preferably melted onto the second shaft section 12 and can even be shaped, e.g. ball shaped. The further thickening 33 can be used with any embodiment of the thickened portion.

The electrode shafts and the thickened portions can be of any appropriate material used in the art. Tungsten with additives like e.g. ThO2, rare-earth oxides or without additives, or tungsten alloys containing e.g. K, Al and/or Si are appropriate for both the electrode shafts and the thickened portions. For the thickened portions, materials with lower melting temperatures like Mo, Re, Os and/or alloys thereof with or without tungsten as an additional alloy additive can also be used.

The above described electrode construction is especially applicable to high intensity discharge lamps with high takeover, run-up and/or steady-state operating currents, and more specifically to high intensity discharge lamps for automotive applications. The proposed electrode construction provides improved reliability and longer product life. These benefits are accomplished by reducing the thermal load on the wall of the discharge vessel at the electrode toot-points, thereby reducing the probability of crack generation and propagation in the wall of the discharge vessel surrounding the electrodes while the lamp is being switched on and off repetitively.

This written description including the best mode uses examples to disclose the invention, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A high intensity discharge lamp comprising a discharge vessel having a wall enclosing a discharge space, an ionizable material contained in said space, and at least two electrodes each having an embedded portion and an electrode shaft extending from the wall of the discharge vessel and ending with a tip of the electrode, the electrodes being arranged in said space for establishment of an electric arc between said tips, wherein each of the electrode shafts of the electrodes comprises a thickened portion arranged between the embedded portion and the tip of the electrode, a first shaft section extending between the embedded portion and the thickened portion, the first shaft section having a first length and a first shaft diameter having substantially the same diameter as the embedded portion, and a second shaft section extending between the thickened portion and the tip of the electrode, the second shaft section having a second length and a second shaft diameter, and wherein the thickened portion has a greater overall diameter than any of the first and second shaft diameters thereby having a specific surface higher than the specific surface of the first shaft section and the specific surface of the second shaft section, respectively, and being arranged to limit the temperature of the electrode shaft at the inner wall by heat dissipation, and the thickened portion has a minimum distance from the inner wall of at least 50% of the first shaft diameter, the length of the second shaft section is at least 100% of the second shaft diameter, and the first length is at most equal to the second length.

2. The high intensity discharge lamp of claim 1, in which the second length is at least 150% of the second shaft diameter.

3. The high intensity discharge lamp of claim 1, in which the second length is at least 200% of the second shaft diameter.

4. The high intensity discharge lamp of claim 1, in which the first shaft diameter and the second shaft diameter are equal to each other.

5. The high intensity discharge lamp of claim 1, in which the thickened portion is formed as an axially quasi-symmetric body.

6. The high intensity discharge lamp of claim 5, in which the axially quasi-symmetric body has a ribbed surface to further increase its specific surface.

7. The high intensity discharge lamp of claim 5, in which the axially quasi-symmetric body has a ball, cylindrical, ellipsoidal, or conical shape.

8. The high intensity discharge lamp of claim 5, in which the axially quasi-symmetric body has a tapering shape.

9. The high intensity discharge lamp of claim 8, in which the tapering shape of the axially quasi-symmetric body follows the shape of the inner wall of the discharge vessel.

10. The high intensity discharge lamp of claim 1, in which the thickened portion is formed as a coil on the electrode shaft.

11. The high intensity discharge lamp of claim 10, in which the coil is welded or melted onto the electrode shaft.

12. The high intensity discharge lamp of claim 10, in which the coil is a multi-layer coil.

13. The high intensity discharge lamp of claim 12, in which the coil has more layers of windings on a side facing towards the tip than on the side facing towards the embedded portion.

14. The high intensity discharge lamp of claim 1, in which the second shaft section is provided with a further thickening at the tip.

15. The high intensity discharge lamp of claim 14, in which the further thickening is formed as a coil welded or melted onto the electrode shaft.

16. A high intensity discharge lamp comprising a discharge vessel having a wall enclosing a discharge space, an ionizable material contained in said space, and at least two electrodes each having an embedded portion and an electrode shaft extending directly from the wall of the discharge vessel and ending with a tip of the electrode, the electrodes being arranged in said space for establishment of an electric arc between said tips, wherein each of the electrode shafts of the electrodes comprises a thickened portion arranged between the embedded portion and the tip of the electrode, a first shaft section extending between the embedded portion and the thickened portion, the first shaft section having a first length and a first shaft diameter having substantially the same diameter as the embedded portion, and a second shaft section extending between the thickened portion and the tip of the electrode, the second shaft section having a second length and a second shaft diameter, and wherein the thickened portion has a greater overall diameter than any of the first and second shaft diameters thereby having a specific surface higher than the specific surface of the first shaft section and the specific surface of the second shaft section, respectively, and being arranged to limit the temperature of the electrode shaft at the inner wall by heat dissipation, and the thickened portion has a minimum distance from the inner wall of at least 50% of the first shaft diameter, the length of the second shaft section is at least 100% of the second shaft diameter, and the first length is at most equal to the second length.

* * * * *